US006224405B1

(12) United States Patent
Eland

(10) Patent No.: US 6,224,405 B1
(45) Date of Patent: May 1, 2001

(54) ELECTRICAL CONNECTOR WITH EJECTOR MECHANISM

(75) Inventor: Michael P Eland, Fort Collins, CO (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/303,271

(22) Filed: Apr. 30, 1999

(51) Int. Cl.[7] ..... H01R 13/62
(52) U.S. Cl. ..... 439/160; 439/152
(58) Field of Search ..... 439/159, 160, 439/152; 361/600, 679, 683

(56) References Cited

U.S. PATENT DOCUMENTS

| | | | | |
|---|---|---|---|---|
| 5,057,029 | | 10/1991 | Noorily | 439/160 |
| 5,421,737 | | 6/1995 | Chen et al. | 439/157 |
| 5,443,395 | | 8/1995 | Wang | 439/159 |
| 5,791,920 | | 8/1998 | Tomilka et al. | 439/159 |
| 5,801,926 | | 9/1998 | Cutsforth et al. | 361/754 |
| 5,906,497 | * | 5/1999 | Pham et al. | 439/160 |
| 6,075,702 | * | 6/2000 | Gardner et al. | 361/704 |

* cited by examiner

*Primary Examiner*—Khiem Nguyen
*Assistant Examiner*—Michael C. Zarroli
(74) *Attorney, Agent, or Firm*—Kevin MarHart

(57) ABSTRACT

An electrical connector assembly having an ejector mechanism built thereon. Left and right ejector lever mounts are fixed on left and right sides of an electrical connector. A rigid handle couples dual ejector levers pivotally engaged with the left and right ejector lever mounts. The levers actuate ejector pads for engaging a circuit board and urging the connector away from its counterpart on the circuit board. A u-shaped connector assembly may be made from two of the connector and ejector lever arrangements. A cable joins the two arrangements, and the entire assembly may be used to couple signals from a first to a second circuit board or to another component. Once the assembly is installed on the circuit boards, a u-shaped retainer bracket may be installed on top of the assembly. The retainer bracket helps to guarantee a reliable electrical connection by urging the connectors toward their counterparts on the circuit boards. The retainer bracket may be provided with clearance holes for receiving raised portions of the ejector lever handles, thereby preventing lateral motion of the retainer bracket once installed.

12 Claims, 5 Drawing Sheets

ELECTRICAL CONNECTOR WITH EJECTOR MECHANISM

FIELD OF THE INVENTION

This invention relates to electrical connectors, and more particularly to an electrical connector having an ejector mechanism attached thereto.

BACKGROUND

In certain electrical applications, particularly in computer applications, a need exists for electrical connectors that are capable of coupling hundreds of signals between a printed circuit board and other components or printed circuit boards. Such connectors also need to provide reliable electrical connections. In order to ensure that such connectors do not come apart inadvertently, various means have been employed to guarantee a tight mechanical fit between the mating pieces. These efforts have succeeded in providing high-signal-count connectors that provide reliable electrical connections. Unfortunately, it is sometimes very difficult to separate the mating pieces of these connectors when it is necessary to do so.

It is therefore an object of the invention to provide a high-signal-count electrical connector that ensures reliable connections when mated with its counterpart, but that is not difficult to separate from its counterpart when it is necessary to do so.

SUMMARY OF THE INVENTION

In one aspect, the invention includes an electrical connector assembly having an ejector mechanism built thereon. An electrical connector is provided, and left and right ejector lever mounts are fixed on left and right sides of the electrical connector. A dual ejector lever is also provided. The dual ejector lever includes left and right ejector levers having left and right pivot points, respectively. The left and right ejector levers are mechanically coupled together on one side of the left and right pivot points by a rigid handle, and they have an ejector pad on the other side of the left and right pivot points for engaging a circuit board. The left and right ejector levers are pivotally engaged with the left and right ejector lever mounts at the left and right pivot points. After the electrical connector has been mated with a counterpart connector on the circuit board, the two may be separated easily by rotating the handle. The rotation causes the ejector pads to engage the circuit board, thereby urging the connector away from its counterpart on the circuit board. The mechanical advantage provided by the lever greatly reduces the separation force required to complete the operation.

In another aspect, the invention includes a u-shaped connector assembly made from two of the just-described connector and ejector lever arrangements. A cable joins the two arrangements, and the entire assembly may be used effectively to coupled hundreds of signals from a first to a second circuit board, or to another component. Once the assembly is installed onto the circuit boards, a u-shaped retainer bracket may be installed on top of the assembly. The retainer bracket helps to guarantee a reliable electrical connection by urging the connectors toward their counterparts on the circuit boards. Thus, the connectors themselves need not be designed to provide an excessively tight fit to guarantee the connections. The retainer bracket may be provided with clearance holes for receiving raised portions of the ejector lever handles, thereby preventing lateral motion of the retainer bracket once installed.

DETAILED DESCRIPTION OF THE PREFERRED EMBODIMENTS

Figure 1:
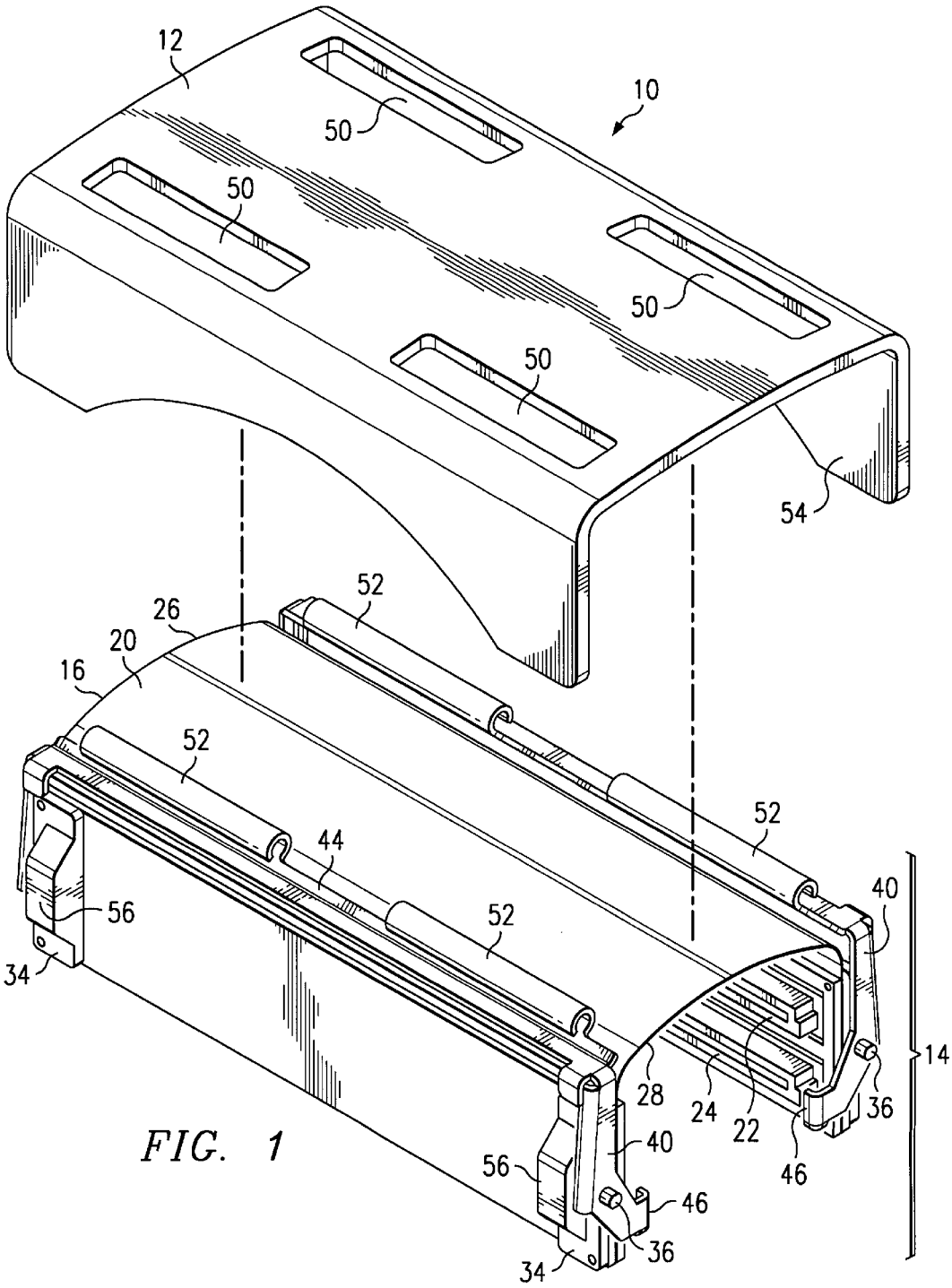
FIG. 1 is an oblique view of an electrical connector assembly according to a preferred embodiment of the invention having its retainer bracket removed.

Electrical connector assembly 10 includes a u-shaped retainer bracket 12 and an electrical assembly 14. Electrical assembly 14 includes a cable 16 having a connector side 18 and a back side 20. In an embodiment, cable 16 was made of flexible copper etched with four hundred conductor traces and coated with an insulating material. In other embodiments, other kinds of cable may be used, including ribbon cable. Top electrical connector 22 and bottom electrical connector 24 are disposed on connector side 18 of cable 16 and are electrically connected to conductors within the cable. In an embodiment, each connector housed two hundred contacts, for a total of four hundred. Connectors 22 and 24 extend longitudinally across cable 16 from left edge 26 to right edge 28. Back-side backing material 30 is a substantially rigid member extending across the back side 20 of cable 16 from left edge 26 to right edge 28 behind top and bottom connectors 22, 24. Connector-side backing material 32 is a substantially rigid member extending across the connector side 18 of cable 16 from left edge 26 to right edge 28 adjacent to top and bottom connectors 22, 24. In an embodiment, all backing material was made of fiberglass, although other materials may be used. The purpose of the backing material is to rigidly couple ejector lever mounts 34 to top and bottom connectors 22, 24.

Figure 7:
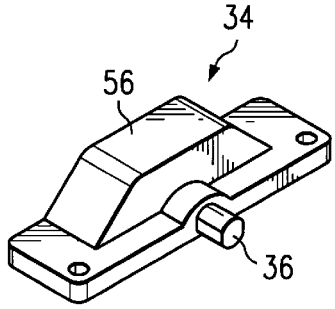
FIG. 7 is an oblique view of the front of one of the ejector lever mounts of FIGS. 1–4.
Figure 8:
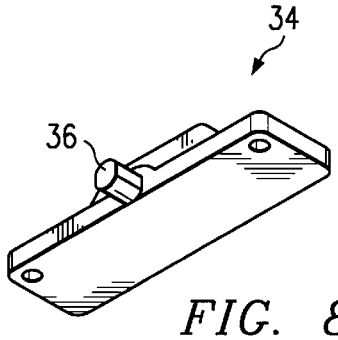
FIG. 8 is an oblique view of the bottom of the ejector lever mount of FIG. 7.

Ejector lever mounts 34 may be fastened to both the connector-side backing material 32 and the back-side backing material 30 by conventional means, such as with through-hole rivets. Or, mounts 34 may be cast with rivets integrally formed thereon. FIGS. 7 and 8 provide detailed views of ejector lever mounts 34. Ejector lever mounts 34 have a pivot pin 36 integrally formed thereon for engagement with pivot holes 38 in ejector levers 40. When mounts 34 are fastened to the backing material, preferably the pivot pins 36 should be oriented axially along a pivot line that is parallel with the axes of the top and bottom connectors 22, 24. If both top and bottom connectors 22, 24 require equal force to separate them from their counterpart connectors (this will normally be the case, for example, if top and bottom connectors house the same number of contacts or are identical), then it is preferable to dispose the pivot line substantially equidistant from the axes of the top and bottom connectors 22,24. During connector separation, such a disposition helps in causing top and bottom connectors 22, 24 to pull away from their counterparts orthogonally rather than at an angle.

Figure 4:
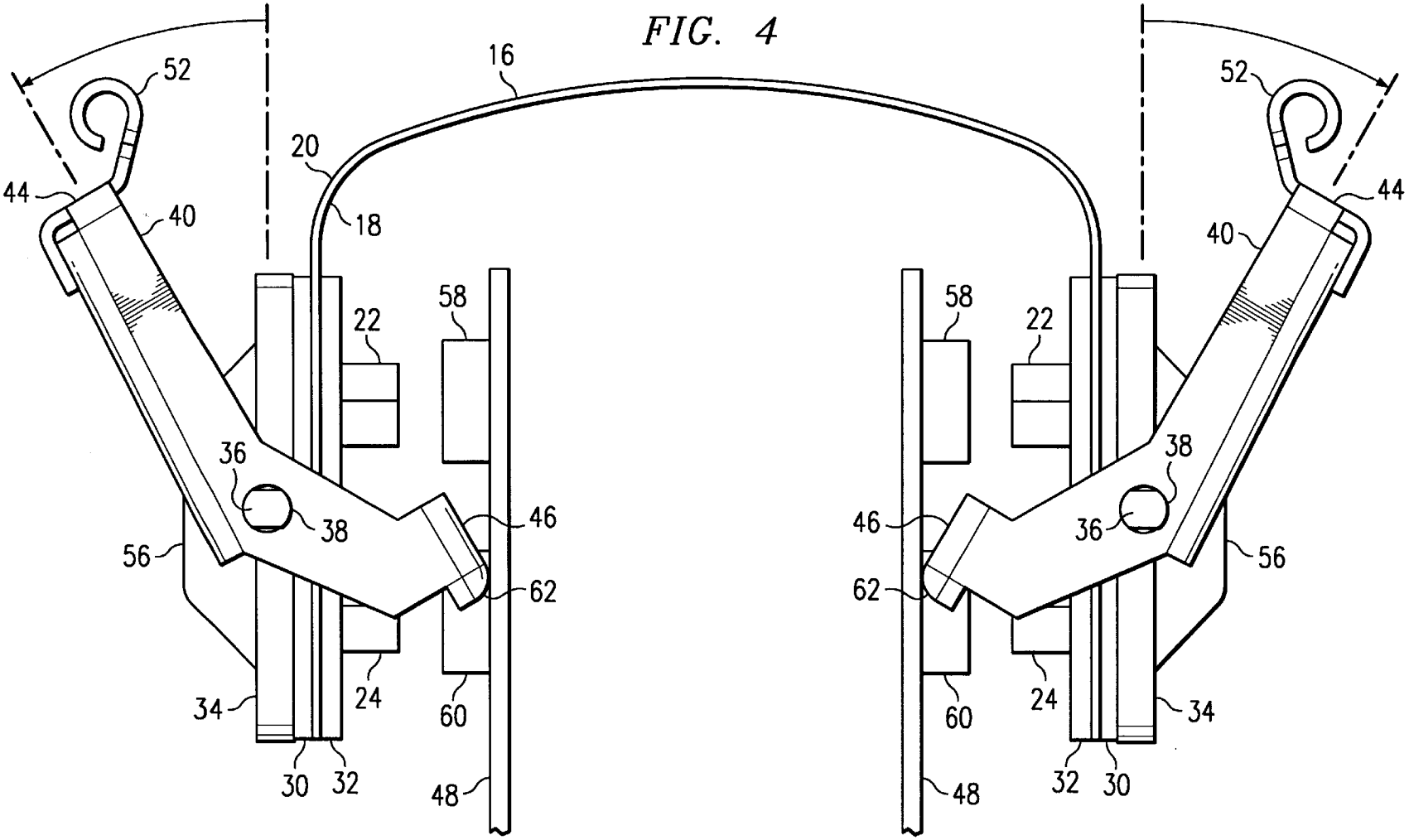
FIG. 4 is an end view of the electrical connector assembly of FIG. 3 having its retainer bracket removed and having been separated from printed circuit board connectors by its ejector levers.
Figure 5:
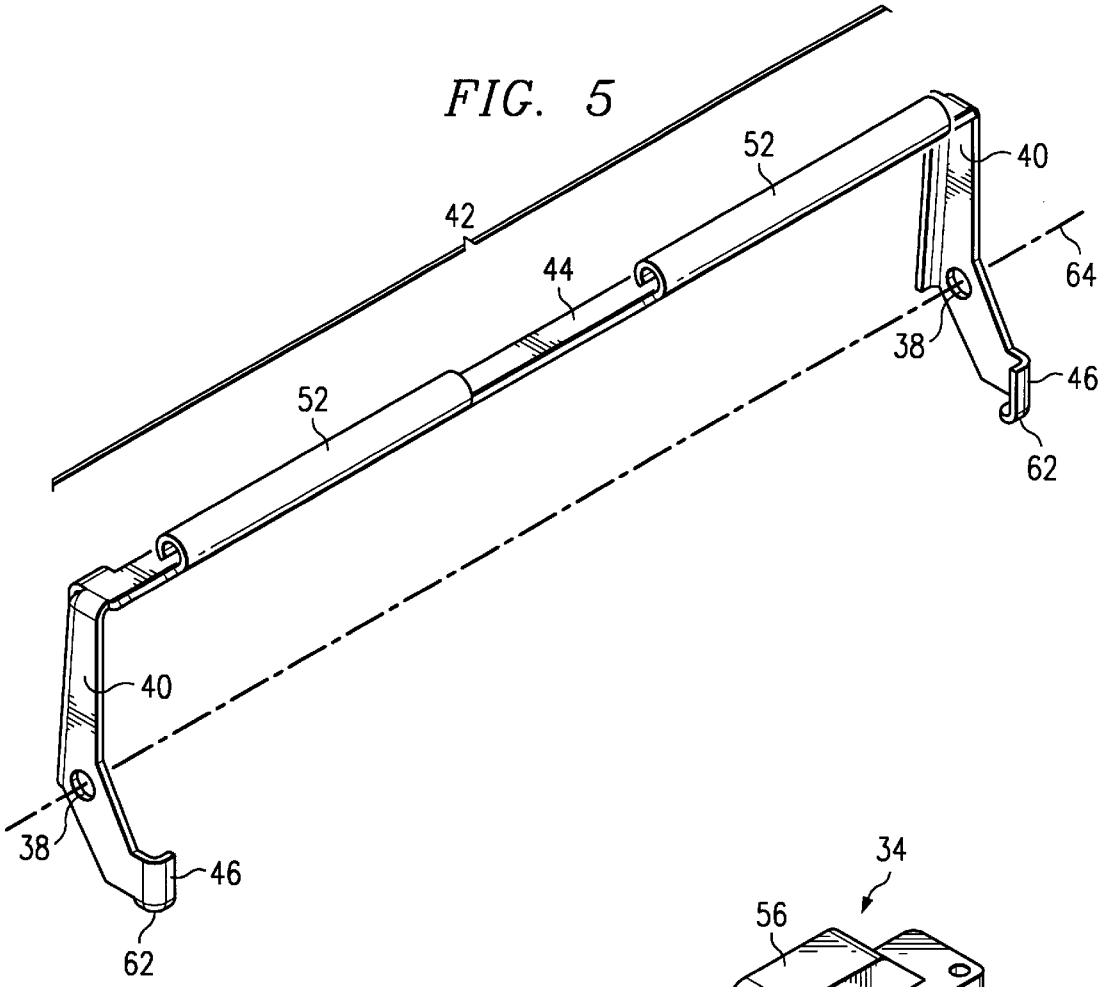
FIG. 5 is an oblique view of one of the ejector levers of FIGS. 1–4.
Figure 6:
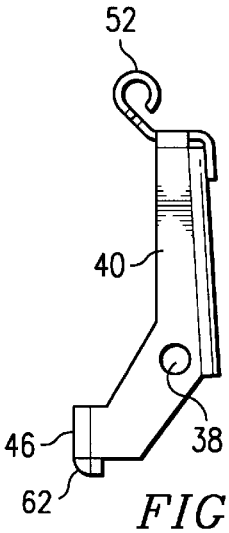
FIG. 6 is a side view of the ejector lever of FIG. 5.

FIGS. 5 and 6 provide detailed views of dual ejector levers 42. Each dual ejector lever 42 includes left and right ejector levers 40 coupled together by a longitudinal handle 44. At the end of ejector levers 40 opposite handle 44 is an ejector pad 46 for engaging a circuit board surface 48. Preferably, edge 62 of ejector pad 46 is contoured so that its cross-sectional shape is concave toward pivot line 64. This is done so that engagement of ejector pad 46 with circuit board surface 48 does not score the circuit board. As can be seen by the rotation directions indicated in FIG. 4, ejector levers 40 are pivotally engaged with pivot pins 36. In an embodiment, the ends of pivot pins 36 were flared over the edges of pivot holes 38 using a well-known spin staking technique in order to better secure dual ejector levers 42 to mounts 34. In addition, ejector lever mounts 34 were die-cast from zinc. Although other materials may be used, the zinc material facilitated spin staking of the ends.

Figure 2:
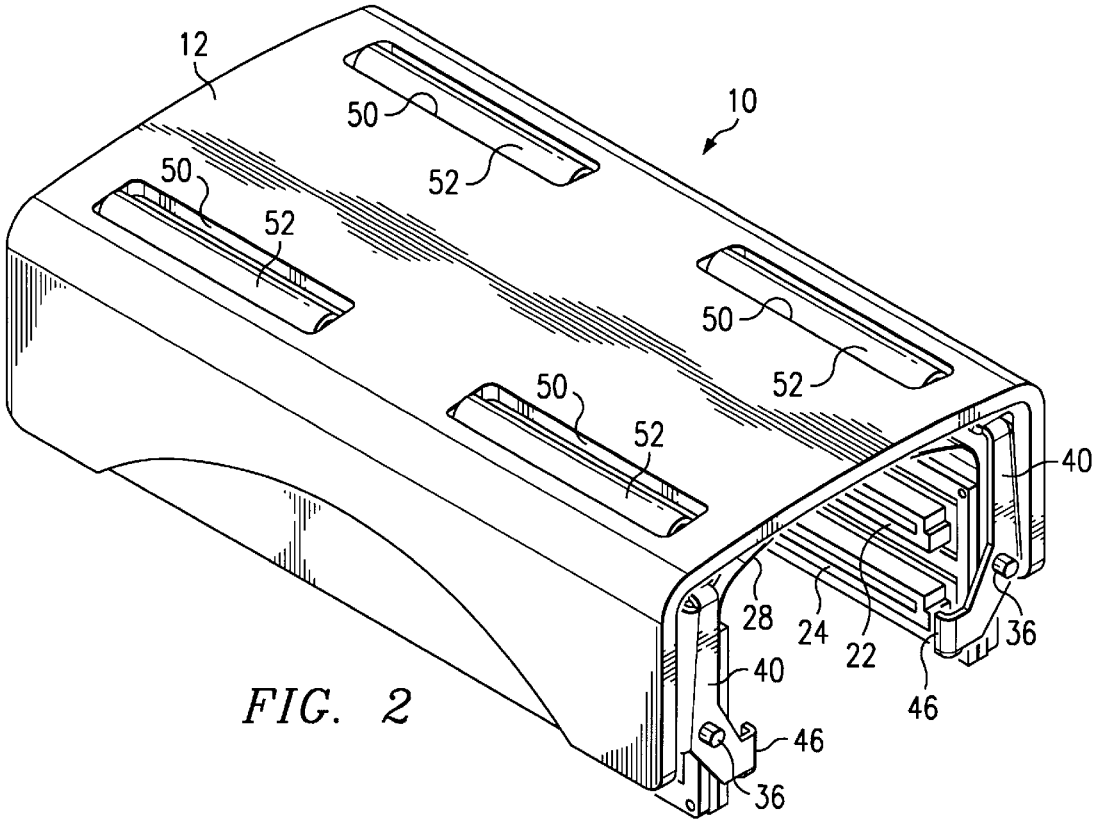
FIG. 2 is an oblique view of the electrical connector assembly of FIG. 1 having its retainer bracket installed.
Figure 3:
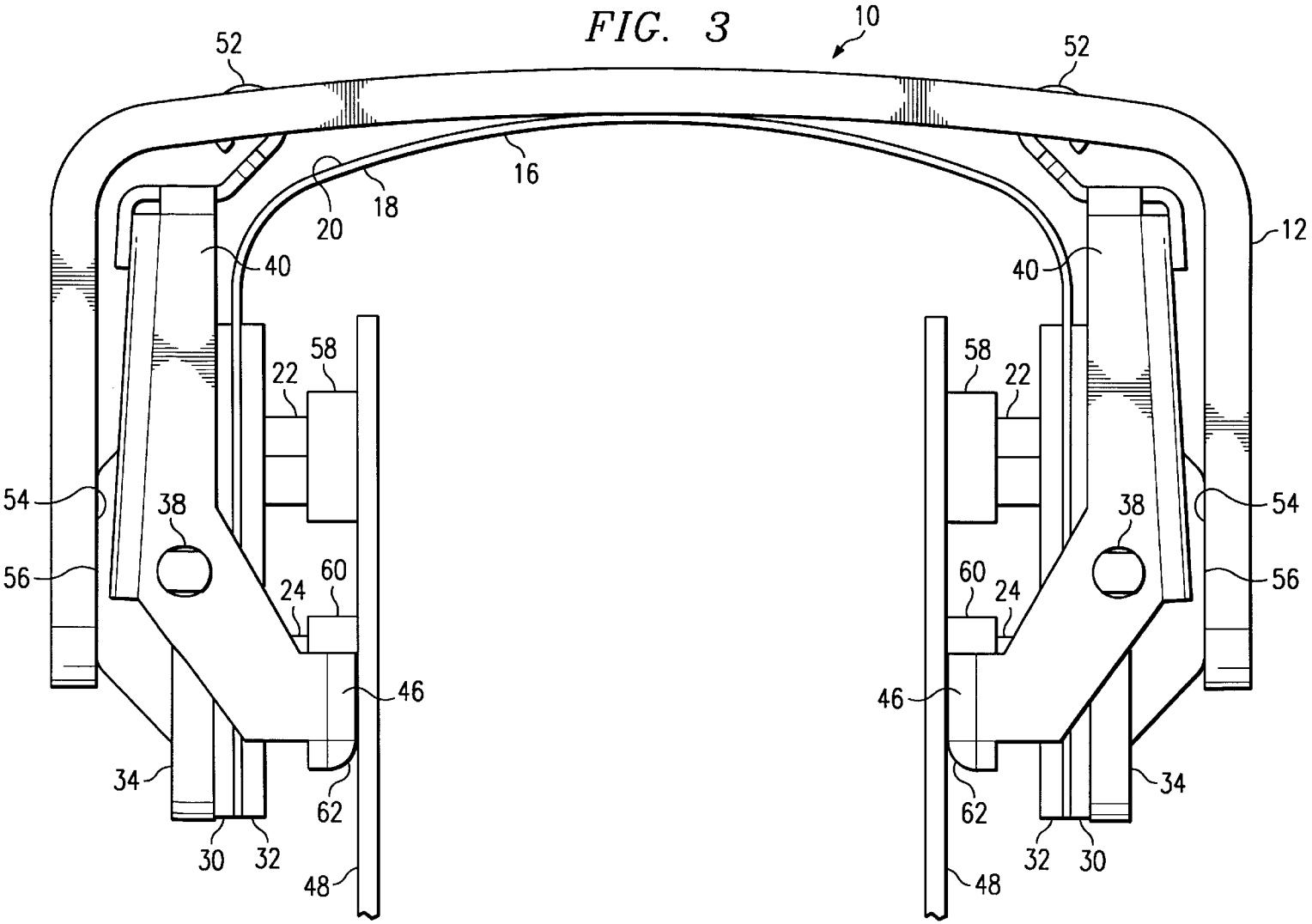
FIG. 3 is an end view of the electrical connector assembly of FIG. 2 mated with printed circuit board connectors.

U-shaped retainer bracket 12 is provided with clearance holes 50 for receiving raised portions 52 of longitudinal handles 44. When retainer bracket 12 is installed onto electrical assembly 14 as shown in FIGS. 2 and 3, clearance holes 50 engage raised portions 52 and thereby prevent lateral motion of retainer bracket 12. Retainer bracket 12 also is provided with inner bearing surfaces 54 for engaging outer bearing surfaces 56 formed on each of the ejector lever mounts 34. In an embodiment, retainer bracket 12 was made of stainless steel to reduce bulk while still providing retaining strength, although other materials may be used.

In operation, retainer bracket 12 urges top and bottom connectors 22, 24 against their counterparts 58, 60 when installed. One of the benefits achieved by the use of retainer bracket 12 is that the connectors need not be designed to provide excessive pressure or an excessively tight fit in order to guarantee a reliable electrical connection. Moreover, any outward bias caused by the springy characteristics of cable 16 are counteracted by retainer bracket 12.

When the connectors are to be separated, retainer bracket 12 is removed. Then, handles 44 are rotated outward as shown in FIG. 4. The outward rotation of the handles 44 causes an inward rotation of ejector pads 46. The engagement of pads 46 with circuit board surfaces 48 urges top and bottom connectors 22, 24 orthogonally away from circuit board surface 48, causing them to separate from their counterpart connectors 58, 60. The mechanical advantage contributed by levers 40 greatly reduces the force required to separate the components.

While the invention has been described herein with reference to a particular embodiment, the illustrated embodiment has been shown by way of example and not by way of limitation. Persons having ordinary skill in the art and having reference to this specification will appreciate that various alternative embodiments may be created while remaining within the scope of the following claims and their equivalents.

What is claimed is:

1. An electrical connector assembly, comprising:

a cable having an electrical connector thereon;

left and right ejector lever mounts disposed on left and right sides of the electrical connector, respectively;

a substantially rigid member fixedly coupled to the left and right ejector lever mounts, at least one of the substantially rigid member and the ejector lever mounts fixedly coupled to the cable; and a dual ejector lever comprising left and right ejector levers mechanically coupled together by a handle and pivotally engaged with the left and right ejector lever mounts.

2. The electrical connector assembly of claim 1, wherein the electrical connector comprises first and second longitudinal connectors with axes oriented parallel with one another; and wherein the left and right ejector lever mounts define a pivot line that is parallel with the axes of the first and second longitudinal connectors.

3. The electrical connector assembly of claim 2, wherein a portion of each ejector pad is concave toward the pivot line.

4. An electrical connector assembly, comprising:

a cable;

a first electrical connector electrically connected to conductors within the cable at a first position;

a second electrical connector electrically connected to conductors within the cable at a second position different than the first position;

first left and right ejector lever mounts disposed on left and right sides of the first electrical connector, respectively;

a first dual ejector lever comprising first left and right ejector levers mechanically coupled together by a first handle and pivotally engaged with the first left and right ejector lever mounts;

second left and right ejector lever mounts disposed on left and right sides of the second electrical connector, respectively; and a second dual ejector lever comprising second left and right ejector levers mechanically coupled together by a second handle and pivotally engaged with the second left and right ejector lever mounts.

5. The electrical connector assembly of claim 4, further comprising;

bearing surfaces formed on the first and second left and right ejector lever mounts for engaging a retainer bracket.

6. The electrical connector assembly of claim 4, wherein at least the first electrical connector comprises first and second longitudinal connectors with axes oriented parallel with one another; and wherein the first left and right ejector lever mounts define a first pivot line that is parallel with the axes of the first and second longitudinal connectors.

7. The electrical connector assembly of claim 6, wherein a portion of each ejector pad of the first dual ejector lever is concave toward the first pivot line.

8. An electrical connector assembly, comprising:

a cable having a connector side and a back side;

first top and bottom connectors disposed on the connector side of the cable at a first end, electrically connected to conductors within the cable, and extending longitudinally across the cable from a left edge to a right edge;

second top and bottom connectors disposed on the connector side of the cable at a second end, electrically connected to conductors within the cable, and extending longitudinally across the cable from the left edge to the right edge;

a first back-side rigid member extending across the back side of the cable from the left edge to the right edge behind the first top and bottom connectors;

a first connector-side rigid member extending across the connector side of the cable from the left edge to the right edge adjacent to the first top and bottom connectors;

a second back-side rigid member extending across the back side of the cable from the left edge to the right edge behind the second top and bottom connectors;

a second connector-side rigid member extending across the connector side of the cable from the left edge to the right edge adjacent to the second top and bottom connectors;

first left and right ejector lever mounts fastened to the first connector-side and back-side rigid members at the left and right edges, respectively;

second left and right ejector lever mounts fastened to the second connector-side and back-side rigid members at the left and right edges, respectively;

the first left and right ejector lever mounts having first left and right pivot pins, respectively, the first left and right pivot pins pointing away from one another and oriented axially along a line that is parallel with the axes of the first top and bottom connectors;

the second left and right ejector lever mounts having second left and right pivot pins, respectively, the second left and right pivot pins pointing away from one another and oriented axially along a line that is parallel with the axes of the second top and bottom connectors;

a first dual ejector lever comprising first left and right ejector levers coupled together by a first handle and having a first ejector pad for engaging a first circuit board, the first left and right ejector levers pivotally engaged with the first left and right pivot pins, respectively;

a second dual ejector lever comprising second left and right ejector levers coupled together by a second handle and having a second ejector pad for engaging a second circuit board, the second left and right ejector levers pivotally engaged with the second left and right pivot pins, respectively; and a retainer bracket having inner bearing surfaces for engaging outer bearing surfaces formed on each of the first and second left and right ejector lever mounts.

9. The electrical connector assembly of claim 5, further comprising:

a retainer bracket operable to slide over the first and second left and right ejector lever mounts and to contact the bearing surfaces formed thereon so as to hold the first and second electrical connectors in mated relationship with first and second mating connectors, respectively.

10. The electrical connector assembly of claim 9, wherein the retainer bracket is u-shaped.

11. The electrical connector assembly of claim 8, wherein the retainer bracket is substantially u-shaped.

12. The electrical connector assembly of claim 8, wherein the retainer bracket defines first and second holes for receiving raised portions of the first and second handles, respectively.

* * * * *